US006098624A

United States Patent [19]

Utamaru

[11] Patent Number: 6,098,624

[45] Date of Patent: Aug. 8, 2000

[54] SIMPLE MASK FOR PROTECTION OF RESPIRATORY SYSTEM

[76] Inventor: Masanobu Utamaru, 403, Hillbrook House Akiya Beach, 5347, Akiya, Yokosuka 240-01, Japan

[21] Appl. No.: 09/345,893

[22] Filed: Jul. 1, 1999

Related U.S. Application Data

[63] Continuation-in-part of application No. 08/977,101, Nov. 24, 1997, abandoned.

[30] Foreign Application Priority Data

Dec. 16, 1996 [JP] Japan ..... 8-353487

[51] Int. Cl.[7] ..... A62B 7/10; A62B 18/02

[52] U.S. Cl. ..... 128/206.18; 128/206.14; 128/205.29; 128/207.13

[58] Field of Search ..... 128/205.29, 206.11, 128/206.14, 206.18, 207.13

[56] References Cited

U.S. PATENT DOCUMENTS 4,004,584 1/1977 Geaney .
4,984,302 1/1991 Lincoln .
5,392,773 2/1995 Bertrand .
5,740,798 4/1998 McKinney ..... 128/206.18

FOREIGN PATENT DOCUMENTS 6431762 2/1989 Japan .
2-94567 7/1990 Japan .
7-00386 1/1995 Japan .

*Primary Examiner*—John G. Weiss
*Assistant Examiner*—Todd M. Martin
*Attorney, Agent, or Firm*—Trexler, Bushnell, Giangiorgi & Blackstone, Ltd.

[57] ABSTRACT

A simple, inexpensive mask which is generally not bulky, and quite easy to handle, and is applicable to a limited portion of the face. The mask is configured to accommodate various sizes and shapes of nostril openings. The mask includes an air filter having an area which is capable of covering nostril openings, a pair of adhesive sheets which project outwardly from non-parallel side edges of the air filter, and an adhesive layer which is provided on respective upper surfaces of the adhesive sheet and is capable of being adhered to both side portions of a nose. Removable papers are provided, fitted on the adhesive layer. The air filter includes a flexible flap for adjusting a size between an arc-shaped line of the air filter and a facial skin surface below the nose.

3 Claims, 2 Drawing Sheets

SIMPLE MASK FOR PROTECTION OF RESPIRATORY SYSTEM

RELATED APPLICATION

This application is a continuation-in-part of U.S. patent application Ser. No. 08/977,101, filed Nov. 24, 1997 now abandon.

FIELD OF THE INVENTION

The present invention relates generally to a mask for protecting the respiratory system of a human body from an environmental ambient condition. More specifically, the invention relates to a disposable mask.

BACKGROUND

Conventionally, a mask for protecting the respiratory system is generally formed with a rectangular gauze which widely covers not only nostril openings, but also the mouth. The mask also includes a pair of elastic rings which are connected at opposite ends of the rectangular gauze and are configured to be wound around the ears. In the alternative, the mask is formed with the rectangular gauze, a rhomboid shaped cover and elastic rings which are connected to opposite ends of the cover and are configured to be wound around the ears.

A gas protection mask which is designed to be used during war or disaster covers a greater area of the wearer's face than a general purpose mask. Setting of such a mask on the face is done by tying both ends of the mask to the occipital region or, if the mask is designed as such, by placing a bag-like mask over the head.

In the normal course of life, there are many situations where it would be desirable to protect one's respiratory system from the external environment. For example, there are situations where it would be desirable to protect one's respiratory system from disease-causing bacteria, influenza viruses and the like, dust, flying anther dust, spraying chemicals, exhaust gas, the smoke from cigarettes, fumes resulting from painting, drying, low temperature and so forth, for maintaining the body in a healthy condition. However, the conventional mask covers not only one's nostrils, but also one's mouth, thereby covering the lower half of the face below the eyes. Therefore, the mask is generally too bulky to carry.

U.S. Pat. Nos. 4,004,584 and 5,392,773 disclose a breathing filter which includes a filter layer which covers only the nostril portion of the nose, and a support layer with adhesive material disposed at borders of the filter.

On the other hand, U.S. Pat. No. 4,984,302 discloses a nose-worn air filter which includes a filter element that covers the nostrils and base of the nose, and an adhesive strip which includes two triangular portions which are designed to adhere to the sides of the nose thereby holding the filter in place.

However, the masks disclosed in the above-identified patents are not designed such that they can generally correspond with various sizes and shapes of nostril openings. The line of junction between the base of a nose and the facial surface below the nose actually varies among different people. Nose height also varies from person to person. As a result of not being readily adjustable to correspond to such variables, these masks would have to be produced in numerous sizes and patterns, and could hardly be cost effective.

SUMMARY

An object of the present invention is to provide a disposable simple mask which can be not only formed with inexpensive material, is less bulky and is quite easy to handle, but also can readily accommodate various sizes and shapes of nostril openings.

In order to accomplish the above-mentioned object, a simple mask for protecting a respiratory system is provided, and the mask includes a substantially truncated isosceles triangular air filter member having an area capable of covering the nostril openings, a pair of adhesive sheet members being of triangular or trapezoidal shape, projecting outwardly from non-parallel side edges of the air filter member, an adhesive layer provided on respective upper surfaces of the adhesive sheet members and being capable of being adhered to both side portions of a nose, and removable papers which are fitted on the adhesive layer for protecting the latter before use. The air filter member includes a flexible flap which evenly projects from an arc-shaped line between the broadest ends on the non-parallel side edges of the air filter member, for adjusting a size between the arc-shaped line and a facial skin surface below the nose of a mask-wearer. Preferably, the flap has side edges which disconnect from the pair of adhesive sheet members.

The pair of adhesive sheet members may be integrally connected by a connecting portion extending below the air filter member. In such a case, it is preferred that openings which permit aspiration be formed in the connecting portion, located below the air filter member.

BRIEF DESCRIPTION OF THE DRAWINGS

The present invention will be understood more fully from the detailed description given herebelow and from the accompanying drawings of embodiments of the present invention, which, however, should not be taken to be limitative to the invention, but are for explanation and understanding only.

In the drawings.

DESCRIPTION

The present invention will be discussed hereinafter in detail in terms of embodiments of the present invention with reference to the accompanying drawings. In the following description, numerous specific details are set forth in order to provide a thorough understanding of the present invention. It will be obvious, however, to those skilled in the art that the present invention may be practiced without these specific details. In other instances, well-known structures are not shown in detail in order to avoid unnecessarily obscuring the description.

Figure 2:
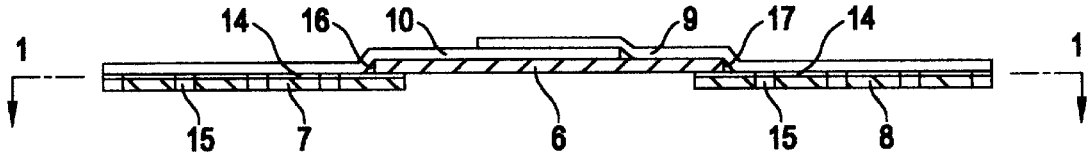
FIG. 2 is a front elevation, viewed along line 2—2 of FIG. 1, of the mask shown in FIG. 1, showing a strippable paper intact, where the strippable paper is to be removed immediately before the mask is used.
Figure 3:
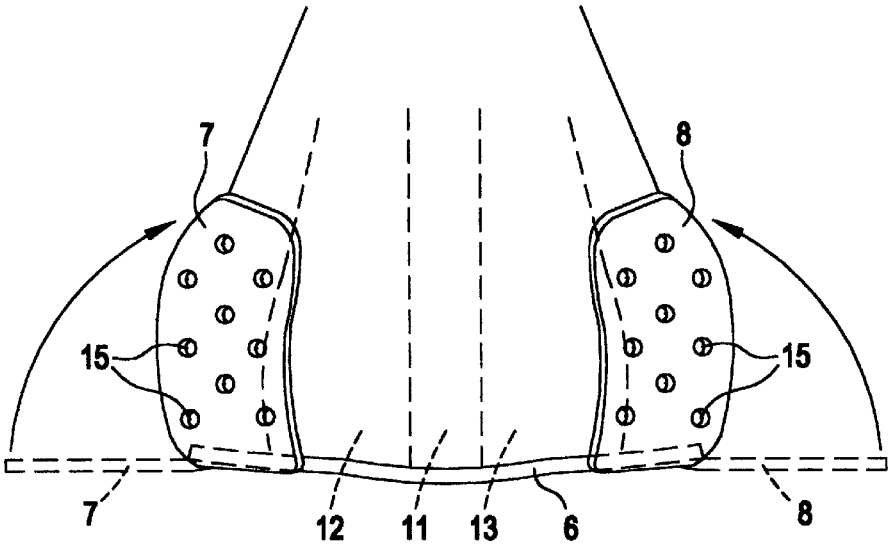
FIG. 3 is a front elevation of the mask shown in FIGS. 1 and 2, showing the mask applied to nostril openings.

Respective parts of a simple mask which is in accordance with a first embodiment of the present invention will be discussed with reference to FIGS. 1–3. The simple mask is formed with an air filter member 6, a pair of adhesive sheet members 7 and 8, a pair of removable papers 9 and 10, and a flap 21 projecting from the air filter member 6.

Raw material of the air filter member 6 may be an air permeable fabric or nonwoven fabric, such as a paper filter, a hemp, a cotton, a felt, a glass fiber and the like, a porous flexible resin, such as vinyl, nylon, polyethylene and the like. Such raw material is used as a single layer or a laminated multiple layer of a sheet formed into the shape covering the nostrils. In some applications, an absorbing agent, such as an active carbon or the like, or an antimicrobial agent or the like may be filled in the air filter member 6.

Figure 1:
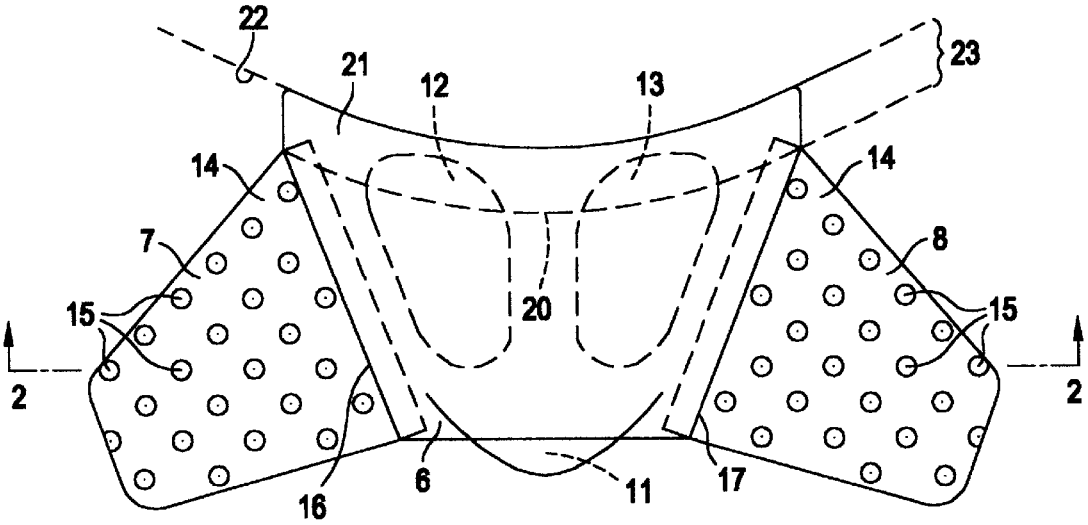
FIG. 1 is a plan view, as viewed along line 1—1 of FIG. 2, of a simple mask which is in accordance with a first embodiment of the present invention

As shown in FIG. 1, the air filter member 6 may be a truncated isosceles triangular configuration having an area capable of at least covering nostril openings 12 and 13 except for an isosceles triangular apex portion 11 of the nose, for example. The relative size of such truncated isosceles triangular shaped areas to be covered will be different depending upon the age, sex, race, and so forth of the mask wearer.

A pair of adhesive sheets 7 and 8 extend sidewardly from two non-parallel edges 16 and 17 of the air filter member 6. For example, as shown, the adhesive sheets 7 and 8 may have a substantially triangular or trapezoidal shaped configuration.

The pair of adhesive sheets 7 and 8 are preferably formed with base members of vinyl chloride, and adhesive layers 14 are applied to the base members. In the alternative, the base member of the adhesive sheet may be the same material as the air filter member 6. In such case, the mask becomes an integral seamless structure. The adhesive is preferably prepared by dissolving a primary material, such as a natural rubber, resin or the like by a solvent using heat. The adhesive is then applied to the base members. Subsequently, the solvent is removed, by evaporation, from the adhesive sheets 7 and 8. Since the adhesive sheets 7 and 8 arc directly applied to the skin of both side surface portions of the nose, less allergic material or non-allergic material is preferred.

Furthermore, since the adhesive sheets 7 and 8 directly cover the surface of the skin and therefore tend to be subject to vital reactions of the human skin, such as cutaneous respiration, sweating or exuded sebum cutaneum, the adhesive sheets 7 and 8 would have a tendency to exfoliate, which is undesirable. To prevent unwanted exfoliation, it is preferred to provide a plurality of permeable holes 15 on the adhesive sheets 7 and 8.

The pair of removable papers 9 and 10 are meant to be removed and disposed immediately before the mask is used. The adhesive layers 14 thus exposed are then adhered to the skin surface of both sides of the nose as shown in FIG. 3. Thus, the adhesive sheets 7 and 8, integrated with the air filter member 6, are adhered to the skin surface on both sides of the nose by adhesion. Accordingly, the upwardly oriented air filter member 6, generally located at the center, is held below the nostril openings 12 and 13.

As shown in FIG. 1, a flexible flap 21 is provided to evenly project from an arc-shaped line 20 between the broadest ends of non-parallel side edges 16 and 17 of the air filter 6. Side edges of the flap 21 are not connected to the pair of adhesive sheet members 7 and 8. The flap can be bent either wholly or partially, so that a bent tip of the flap will keep in close contact with the facial skin below the nose of a mask-wearer, when the mask is affixed to the nose by the adhesive sheet members 7 and 8. While a mask-wearer with a low nose may entirely bend the flap 21, a mask-wearer with a high nose may only partially bend the flap 21. Thus, the flap 21 can adjust to a size 23 between the arc-shaped line 20 and the facial skin surface 22 below the nose of the mask-wearer.

The flexible flap 21 also has the following additional functions. When a mask-wearer tries to inhale through the nostrils, the air filter member 6 which covers the nostril openings 12 and 13 tends to be sucked and pressed to the periphery of the nostril openings 12 and 13, and substantially reduces the possibility of air leakage into them without passing through the air filter member 6. On the other hand, the air exhaled through the nostrils may leak out through the spots where the mask is not pasted to the skin of the mask-wearer. Such an air leakage not only makes the mask-wearer's breathing easier, but also weakens the force of the exhaled air to blow away the mask and helps reduce the size of the adhesive sheet members. Making use of these phenomena, a mask which is in accordance with an embodiment of the present invention may be attached well enough only to a very limited area on each side of the nose. Consequently, the mask is very easy to put on, less uncomfortable to keep on, and is also very price-competitive due to its simple structure.

When the simple mask is to be released, the pair of adhesive sheet members 7 and 8 which are adhered to the skin surface on both sides of the nose are peeled off by hand. By this, the air filter member 6 is also removed from the lower surface of the nose. After removal, the mask can be folded and disposed.

Figure 4:
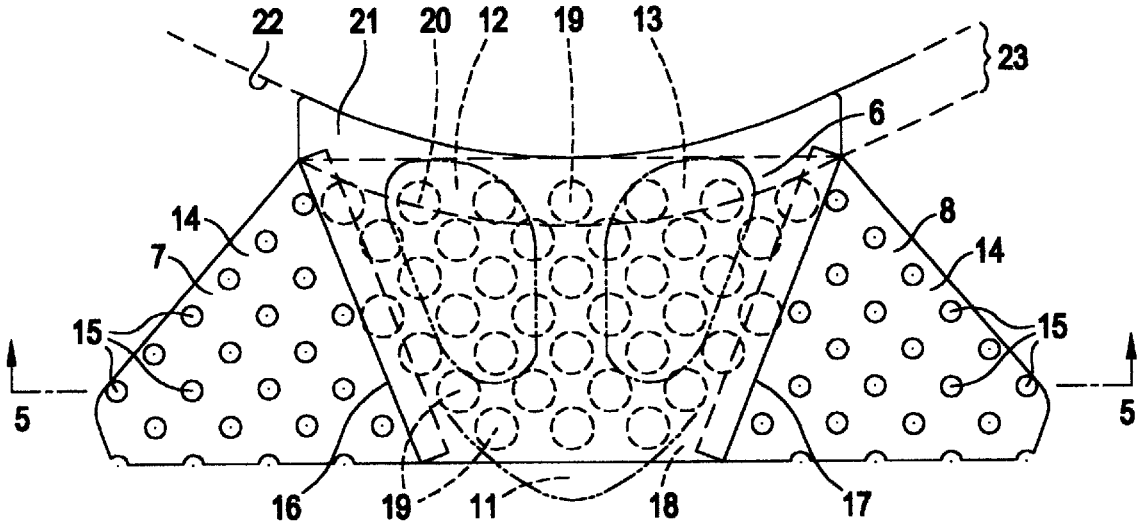
FIG. 4 is a plan view of a mask which is in accordance with a second embodiment of the present invention, where the view is taken along line 4—4 of FIG. 5.
Figure 5:
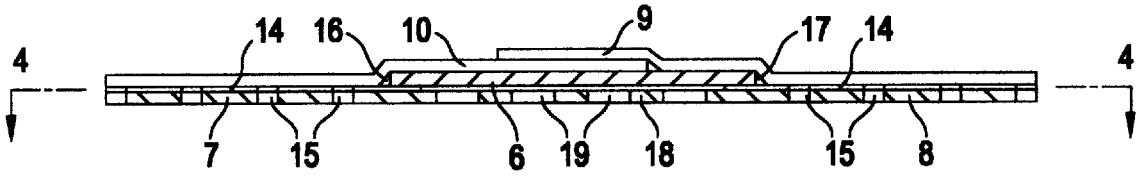
FIG. 5 is a front elevation along line 5—5 of FIG. 4 of the mask shown in FIG. 4, showing a strippable paper intact, where the strippable paper is to be removed immediately before the mask is used.

FIGS. 4 and 5 show a simple mask which is in accordance with a second embodiment of the present invention. The mask shown in FIGS. 4 and 5 is different from that shown in FIGS. 1–3 in that the pair of adhesive sheets 7 and 8 are integrally connected by a connecting sheet 18 which is formed of the same material as that of the adhesive sheets. As shown, the connecting sheet 18 is preferably located below the air filter member 6. Because it is not permissible to block air flow through the air filter member 6, a large number of relatively large air holes 19 are formed through the connecting sheet 18.

Although the present invention has been illustrated and described with respect to exemplary embodiments thereof, it should be understood by those skilled in the art that the foregoing and various other changes, omissions and additions may be made therein and thereto, without departing from the spirit and scope of the present invention. Therefore, the present invention should not be understood as limited to the specific embodiments set out above but to include all possible embodiments which can be embodied within a scope encompassed and equivalents thereof with respect to the feature set out in the appended claims.

What is claimed is:

1. A simple mask for protecting a respiratory system comprising:

a substantially truncated isosceles triangular air filter member having an area capable of covering at least nostril openings;

a pair of adhesive sheet members having at least one of a triangular and trapezoidal shape, said adhesive sheet members projecting outwardly from nonparallel side edges of said air filter member;

an adhesive layer provided on respective upper surfaces of said adhesive sheet members, and being capable of being adhered to both side portions of a nose; and removable papers fitted on said adhesive layer for protecting the adhesive layer before use:

said mask CHARACTERIZED BY, said air filter member having a flexible flap evenly projecting from an arc-shaped line between the broadest ends on the non-parallel side edges of said air filter member, for adjusting a size between said arc-shaped line and a facial skin surface below said nose of a mask-wearer, the flap having side edges disconnecting with said pair of adhesive sheet members.

2. A simple mask as set forth in claim 1, wherein said pair of sheet members are integrally connected by a connecting portion extending below said air filter member.

3. A simple mask as set forth in claim 2, wherein openings permitting aspiration are formed in the connecting portion located below said filter member.

* * * * *